US010959901B1

(12) United States Patent
Jansen et al.

(10) Patent No.: US 10,959,901 B1
(45) Date of Patent: Mar. 30, 2021

(54) CREMATION DISPLAY WITH MOTIONING MEANS

(71) Applicants: William Jansen, Farwell, MI (US); Tamara Jansen, Farwell, MI (US)

(72) Inventors: William Jansen, Farwell, MI (US); Tamara Jansen, Farwell, MI (US)

( * ) Notice: Subject to any disclaimer, the term of this patent is extended or adjusted under 35 U.S.C. 154(b) by 0 days.

(21) Appl. No.: 16/715,287

(22) Filed: Dec. 16, 2019

Related U.S. Application Data

(60) Provisional application No. 62/779,601, filed on Dec. 14, 2018.

(51) Int. Cl.
*A61G 17/08* (2006.01)
*E04H 13/00* (2006.01)
*A61G 17/007* (2006.01)

(52) U.S. Cl.
CPC ..... *A61G 17/08* (2013.01); *E04H 13/008* (2013.01); *A61G 17/007* (2013.01)

(58) Field of Classification Search
CPC .... A61G 17/08; A61G 17/007; E04H 13/008; G09F 19/02; G09F 11/00
USPC ..... 27/1; 40/429, 423, 409, 470, 414, 124.5
See application file for complete search history.

(56) References Cited

U.S. PATENT DOCUMENTS 3,747,243 A * 7/1973 Schneider ..... G09F 13/00 40/436
5,146,701 A * 9/1992 Lee ..... A63H 23/16 40/406
5,704,103 A * 1/1998 Crowley ..... A61G 17/08 27/1
5,706,595 A * 1/1998 Lin ..... G09F 13/24 188/380
5,794,318 A * 8/1998 Parker ..... A61G 17/08 27/1
6,044,532 A * 4/2000 Bowling ..... A61G 17/08 27/1
6,735,831 B1 5/2004 Greiwe et al.
6,785,939 B1 9/2004 James
7,082,653 B1 * 8/2006 Sueppel ..... A47G 1/0616 27/1
7,089,495 B2 * 8/2006 Barrows ..... E04H 13/003 360/12
7,373,703 B1 * 5/2008 Grenci ..... A61G 17/08 27/1
7,475,457 B1 1/2009 Gersten
7,562,423 B2 * 7/2009 Pryd-Kakuk ..... A61G 17/08 27/1
8,046,881 B2 11/2011 Johnson et al.
8,146,216 B2 * 4/2012 Creager ..... A61G 17/08 27/1
8,419,140 B2 4/2013 Ward
(Continued)

*Primary Examiner* — William L Miller
(74) *Attorney, Agent, or Firm* — Cramer Patent & Design, PLLC; Aaron R. Cramer

(57) ABSTRACT

A cremation display is incorporated into a decorative receiver that is operably controlled by a motioning mechanism. The motioning mechanism is located within a base. The base fully supports the decorative receiver. The receiver can take on a decorative element; certain embodiments incorporate an American flag, while certain other embodiments incorporate a heart. Within the decorative receiver is a liquid that creates a decorative effect when the motioning mechanism is activated. The receiver is also configured to hold the cremated remains.

20 Claims, 5 Drawing Sheets

(56) References Cited

U.S. PATENT DOCUMENTS

| | | | | |
|---|---|---|---|---|
| 8,510,921 | B2 * | 8/2013 | Florea | A61G 17/08 27/19 |
| 8,707,526 | B2 * | 4/2014 | Cooke | A61G 17/08 27/1 |
| D708,812 | S | 7/2014 | Freeman | |
| 8,935,837 | B2 * | 1/2015 | Jairala, Jr. | A61G 17/08 27/1 |
| 8,943,657 | B1 | 2/2015 | Perry et al. | |
| 9,198,819 | B2 | 12/2015 | Reynolds | |
| D759,338 | S | 6/2016 | Reynolds | |
| D767,238 | S | 9/2016 | Jennings | |
| D812,337 | S | 3/2018 | Reynolds | |
| 2005/0144821 | A1 * | 7/2005 | Griesemer | A61G 17/08 40/546 |
| 2010/0011631 | A1 * | 1/2010 | Thompson | A47G 1/12 40/1 |
| 2010/0077580 | A1 * | 4/2010 | Holzman | A61G 17/04 27/10 |

* cited by examiner

CREMATION DISPLAY WITH MOTIONING MEANS

RELATED APPLICATIONS

The present invention is a continuation of and was first described in and claims the benefit of U.S. Provisional Application No. 62/779,601, filed Dec. 14, 2018, the entire disclosures of which are incorporated herein by reference.

FIELD OF THE INVENTION

The present invention relates generally to a display for the cremated remains of an individual.

BACKGROUND OF THE INVENTION

The reality of death is something we all must face. While various rituals, practices and methods of internment are used, many rely the use of cremation. This process produces ashes of the deceased that can be spread over a physical area, buried or kept by the descendants in an urn. Many who decide to keep the ashes in an urn then must decide how to best display the urn while maintaining respect for the deceased.

Unfortunately, most urns are of a gloomy nature, and do not fit in well with most decorating schemes. However, out of respect, the family keeps the urn displayed, where it turns into an item that depresses occupants rather than serving as a reminder of pleasant memories. Accordingly, there is a need for a means by which the cremated remains of a loved one can be kept by descendants without the disadvantages as described above. The use of the present invention allows descendants to remember deceased members of the family in a respectful manner while keeping past memories alive.

SUMMARY OF THE INVENTION

The principles of the present invention provide for a remains display comprises a pair of remains receptacles which have a first remains receptacle and a second remains receptacle. The pair of remains receptacles are each incorporated into a reservoir and configured to receive a plurality of cremated remains. The remains display also comprises a decorative portion which is incorporated into a reservoir. A bottom surface of each of the reservoirs, a bottom surface of the first remains receptacles and a bottom surface of the second remains receptacles are fixedly attached to an upper surface of a planar carriage while a bottom surface of the planar carriage at the center point is pivotally attached with a pivot to a base.

The remains display also comprises a first alternate display which has a first alternate first remains receptacle and a first alternate second remains receptacle, a second alternate display which has a second alternate first remains receptacle and a second alternate second remains receptacle and a motor which is electrically attached to a power supply secured within the base. The remains display also comprises a motor gear which is in operable communication with an output shaft of the motor. The motor gear is meshed with and drives a first gear. The first gear is meshed with and drives a second gear. Extending outward from the center of the second gear is a gear shaft that is rendered perpendicular from the top surface and the bottom surface of the box. The remains display also comprises a rod which is driven by the gear shaft and is located off-center to produce a reciprocating action that extends vertically upward and penetrates through the box upper wall to contact the under surface of the planar carriage on either side of either one of the stops. The stops limit the motion of the remains display in either direction and serves to dampen any rocking.

The pair of remains receptacles may each be sa transparent sealed container having a receptacle fill port to facilitate transfer of the cremated remains within. Each of the receptacle fill ports may be sealed with a respective receptacle plug. The decorative portion, the first alternate decorative portion, and the second alternate decorative portion may be made of material selected from the group consisting of tempered glass, plastic, metallic, or one or more organic materials. The reservoirs each may have a transparent sealed container which has a reservoir fill port in fluid communication with an exterior environment to facilitate transfer of a liquid. The reservoir fill ports may each be sealed with a respective reservoir plug. The reservoirs each may incorporate illumination entrained within a liquid introduced. The reservoirs each may incorporate one or more floating objects entrained within the liquid introduce. The planar carriage may be an elongated rectangular prism. The base may have a box upper wall that is pivotally attached to the pivot and may also have a motioning means in operable communication with the planar carriage. On either side of the pivot and affixed to the under surface of the planar carriage may be a pair of stops which are capable of restricting the motioning means on either side of the pivot.

The base may include a bottom wall, a pair of box first walls, a pair of box second side walls, and a box upper wall, the bottom wall, an upper wall, a pair of first side walls, and a pair of second side walls are planar and joined at edges thereof to form a box with a hollow interior. The pair of box first side walls may be coextensive with each other and the pair of box second side walls may also be coextensive with each other. The pair of box first walls may be longer in length than the pair of box second side walls and the pair of box first side walls may have a larger height that the pair of box second side walls. The rod may gently contact an under surface of the planar carriage, which then imparts a pivoting motion to the planar carriage due to the pivot between the planar carriage and the base in a direction opposite the location of the rod. The planar carriage may then pivot to return the under surface of the planar carriage to the rod, which imparts another pivot motion. The power supply may be a battery or a cord in electrical communication with a wall outlet. The motor gear, the first gear, and the second gear may be rotatably supported within the base or to each other. The second gear may be a larger gear than the motor gear to provide a step-down in rotation velocity so as to impart a slow but steady vertical reciprocating movement to the rod.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
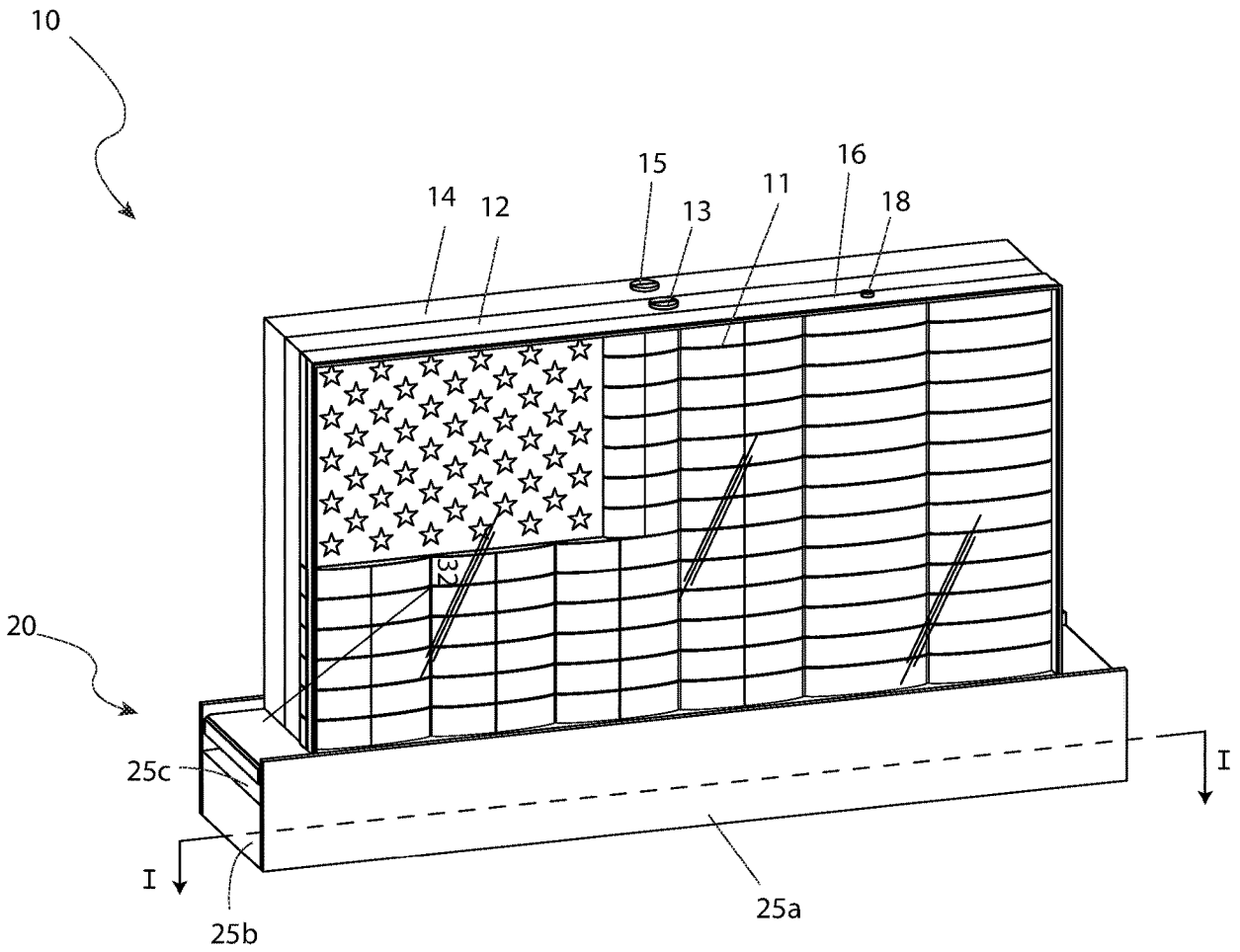
FIG. 1 is a perspective view of the remains display 10, according to a preferred embodiment of the present invention.

10 remains display
11 decorative portion
12 first remains receptacle
13 first receptacle plug
14 second remains receptacle
15 second receptacle plug
16 reservoir
18 reservoir plug
19 gear shaft
20 base
21 motor gear
22 first gear
23 second gear
24 rod
25*a* box first wall
25*b* box second wall
25*c* box upper wall
25*d* box bottom wall
28 motor
30 pivot
31 pivot stop
32 carriage
100 first alternate display
101 first alternate decorative portion
102 first alternate first remains receptacle
103 first alternate first receptacle plug
104 first alternate second remains receptacle
105 first alternate second receptacle plug
106 first alternate reservoir
108 first alternate reservoir plug
200 second alternate display
201 second alternate decorative portion
202 second alternate first remains receptacle
203 second alternate first receptacle plug
204 second alternate second remains receptacle
205 second alternate second receptacle plug
206 second alternate reservoir
207 second alternate reservoir first plug
208 second alternate reservoir second plug
300 AC power plug
305 battery
310 controlling device

1. DESCRIPTION OF THE INVENTION

The best mode for carrying out the invention is presented in terms of its preferred embodiment, herein depicted within FIGS. 1-3 and 6*a*, with alternate embodiments depicted within FIGS. 2-5, 6*b*, and 6*c*. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

The present invention relates to a remains display 10, 100, 200 for displaying the cremated remains of one (1) or two (2) loved ones, whether they be an animal, a relative, or close friend. The remains display 10, 100, 200 can come in any number of desired embodiments, all having the features of a visible means of storing and displaying the cremated remains in a gently reciprocating motioning means.

Figure 3:
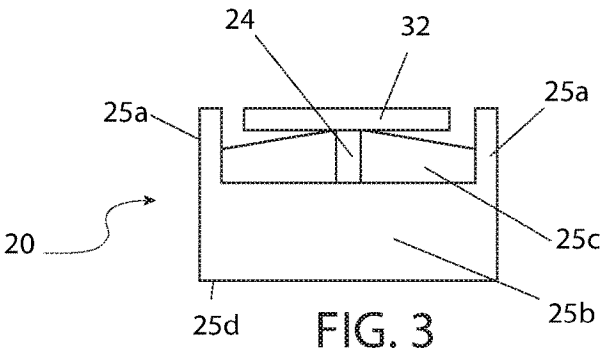
FIG. 3 is a side view of the base 20, according to a preferred embodiment of the present invention.
Figure 4:
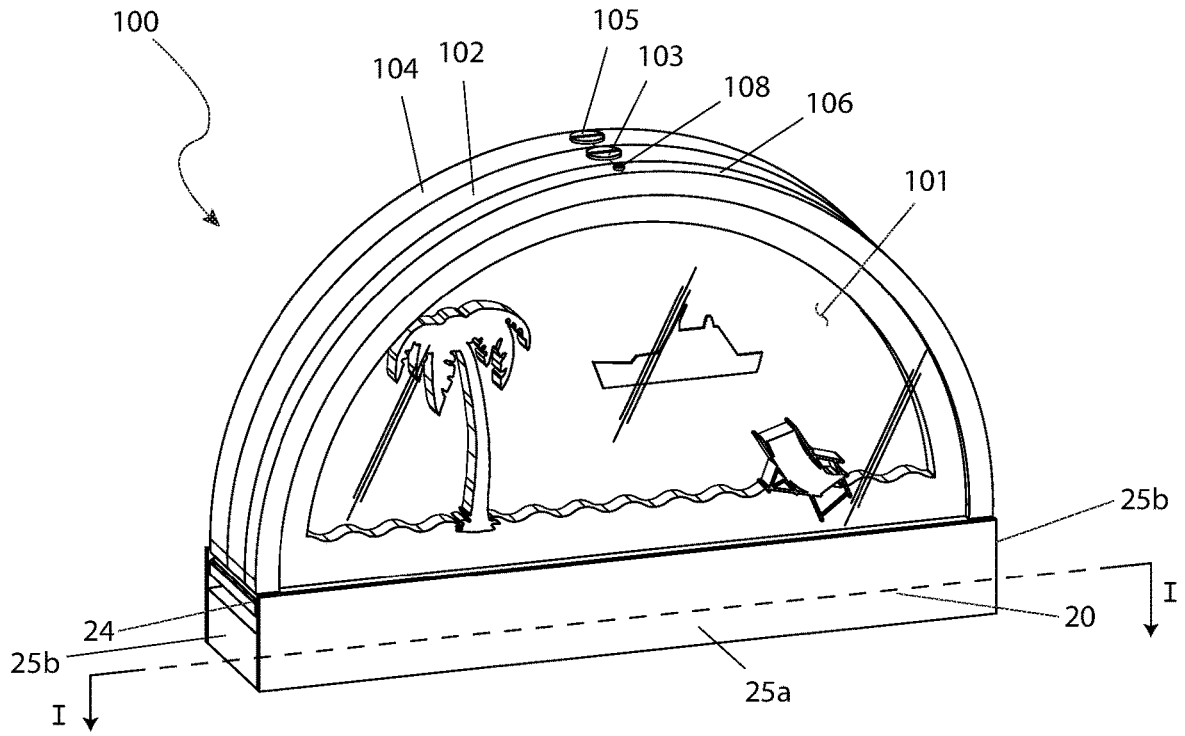
FIG. 4 is a front perspective view of a first alternate display 100, according to an alternate embodiment of the present invention.
Figure 5:
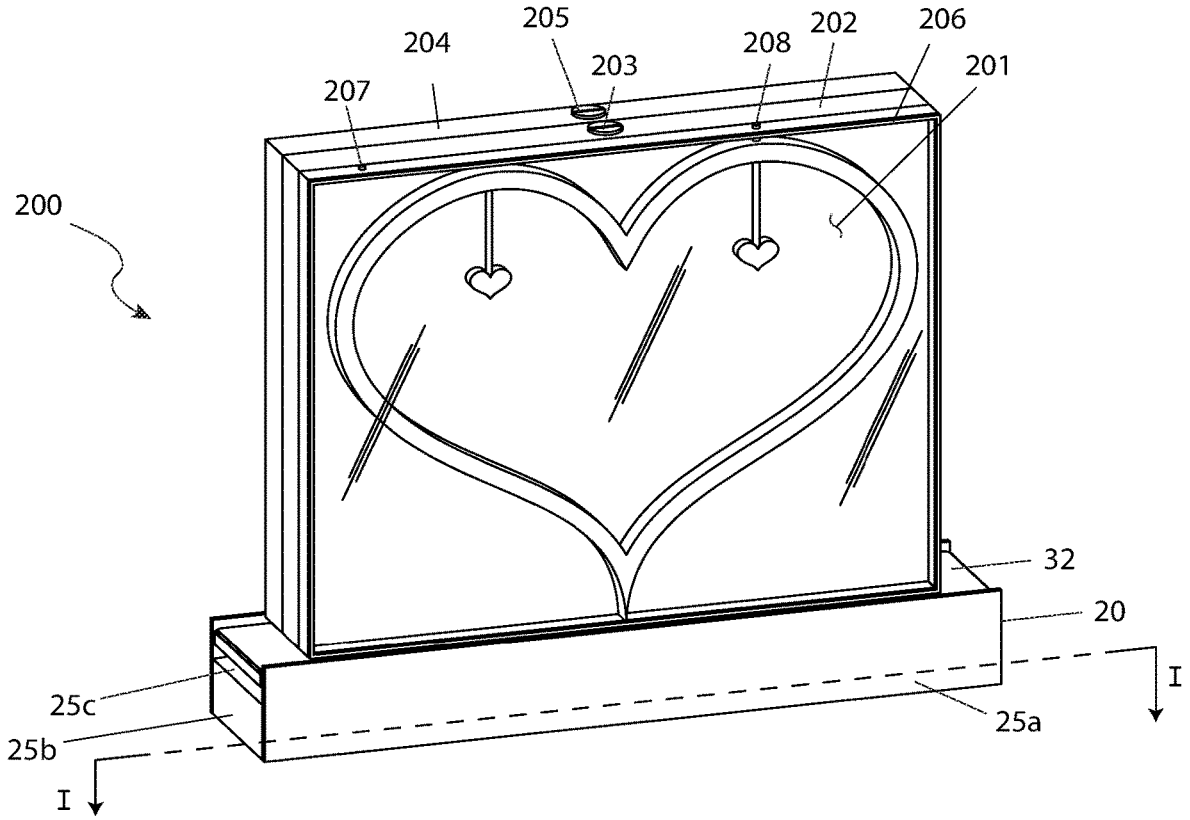
FIG. 5 is a front perspective view of a second alternate display 200, according to another alternate embodiment of the present invention.

Referring now to FIGS. 1, 3, and 4, various illustrations of a remains display 10, 100, 200, depicts, from back to front, a pair of remains receptacles 12, 14, 102, 104, 202, 204, and a decorative portion 11, 101, 201 incorporated into a reservoir 16, 106, 206. The reservoirs 16, 106, 206 are each preferably a transparent sealed container having a reservoir fill port in fluid communication with the environment to facilitate the transfer of liquid. Each reservoir fill port is capable of being sealed with a respective reservoir plug 18, 108, 207, 208. Each reservoir 16, 106, 206 may incorporate illumination or floating objects entrained within any liquid introduced therein.

The remains receptacles 12, 14, 102, 104, 202, 204 are each preferably a transparent sealed container having a receptacle fill port to facilitate the transfer of the cremated remains within. Each receptacle fill port is capable of being sealed with a respective receptacle plug 13, 15, 103, 105, 203, 205. The remains receptacles 12, 14, 102, 104, 202, 204 are each configured to receive an amount of cremated remains therein. Each display 10, 100, 200, is configured to have two (2) remains receptacles (i.e., the remains display 10 has a first remains receptacle 12 and a second remains receptacle 14; the first alternate display 100 has a first alternate first remains receptacle 102 and a first alternate second remains receptacle 104; and the second alternate display 200 has a second alternate first remains receptacle 202 and a second alternate second remains receptacle 204), such that two (2) separate cremated remains are able to stored and displayed.

The decorative portion 11, 101, 201 generally has a recurring theme. In all embodiments, the bottom of the respective display 10, 100, 200 (i.e., the bottom surfaces of the reservoirs 16, 106, 206, first remains receptacles 12, 102, 104, and the second remains receptacles 14, 104, 204). is fixedly attached to an upper surface of a planar carriage 32 and balanced thereon. The carriage 32 is preferably an elongated rectangular prism. The bottom surface of the carriage 32, at the center point thereof, is pivotally attached with a pivot 30 to a base 20. The base 20 has a box upper wall 25*c* that is pivotally attached to the pivot 30 and also has a motioning means therein. The motioning means is in operable communication with the carriage 32. There is a minimal gap between the upper surface of the box upper wall 25*c* and the lower surface of the carriage 32. On either side of the pivot 30 and affixed to the under surface of the carriage 32 is a pair of stops 31. The stops 31 are capable of restricting the motioning means on either side of the pivot 30. The length of the stops 31 are preferably identical and serve to limit the travel of the display 10, 100, 200 due to the operation of the motioning means.

Figure 2:
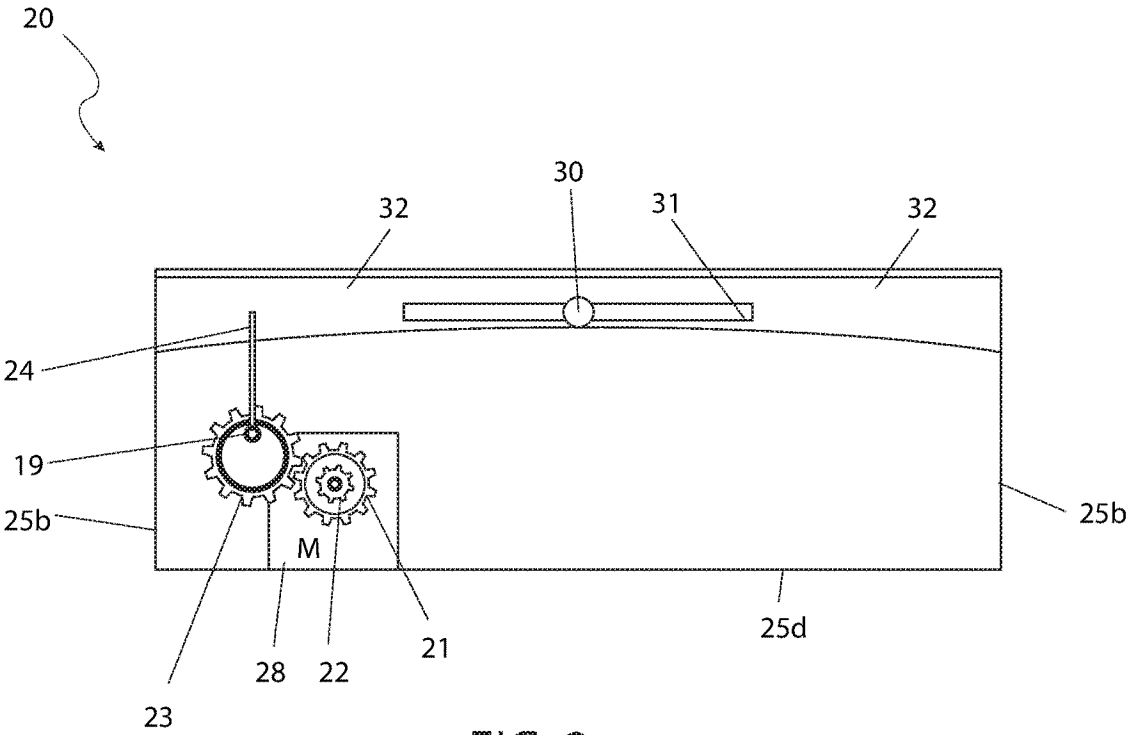
FIG. 2 is cut-away view of the base 20, used with the remains display 10, first alternate display 100 and second alternate display 200 taken along the line I-I (see FIG. 1), according to a preferred embodiment of the present invention.

Referring now to FIGS. 2 and 3, depicting the motioning means in a cut-away view of the base 20, as well as a side view thereof. The base 20 generally comprises a bottom wall 25*d*, a pair of box first walls 25*a* depicted herein as the rear and front sides, a pair of box second side walls 25*b* depicted herein as the left and right sides, and a box upper wall 25*c*. The bottom wall, upper wall 25*c*, first side walls 25*a*, and second side walls 25*b* are planar and joined at edges thereof to form a box with a hollow interior. The pair of box first side walls 25*a* are coextensive with each other and the pair of box second side walls 25*b* are coextensive with each other. The pair of box first walls 25*a* are much longer in length than the pair of box second side walls 25*b* and the pair of box first side walls 25*a* have a larger height that the pair of box second side walls 25*b*. The box upper wall 25*c* is attached to perimeter upper edges of the pair of box second side walls 25*b* and to an intermediate location on the pair of box first side walls 25*a*. The upper surface of the box upper wall 25*c* can be sloped or scalloped, such than an apex thereof is centrally located. It is at this centrally-located apex that the pivot 30 of the display 10, 100, 200 is attached.

Secured within the base 20 (i.e., within the hollow box formed by the base bottom wall 25*d*, base upper wall 25*c*, base first side walls 25*a* and base second side walls 25*b*) is a motor 28 that is configured to be electrically attached to a power supply, whether it is a battery 305 or a cord 300 capable of being in electrical communication with a wall outlet. There may or may not be a power switch 310 in electrical communication between the power supply and the motor 28. A motor gear 21 is in operable communication with an output shaft (not shown) of the motor 28 and driven thereby. The motor gear 21 is meshed with and drives a first gear 22. The first gear 22 is meshed with and drives a second gear 23. Any or all of the aforementioned motor gear 21, first gear 22, and second gear 23 can be rotatably supported within the base 20 or to each other. Extending outward from the center of the second gear 23 is a gear shaft 19 that is rendered perpendicular from the top and bottom surfaces of the box 25.

Driven by the gear shaft 19 is a rod 24, located off-center to produce a reciprocating action, that extends vertically upward and penetrates through the box upper wall 25*c* to contact the under surface of the carriage 32 on either side of either one (1) of the stops 31. This can be accomplished with a worm gear, a rack and pinion gear, or any other gearing system that transfers the rotational movement of the gear shaft 19 to a vertical reciprocating motion of the rod 24. The second gear 23 is preferably a larger gear than the motor gear 21 so as to provide a step-down in rotation velocity so as to impart a slow but steady vertical reciprocating movement to the rod 24. The rod 24 gently contacts the under surface of the carriage 32, which then imparts a pivoting motion to the carriage 32 (and thusly the remains display 10, 100, 200) due to the pivot 30 between the carriage 32 and the base 20 in a direction opposite the location of the rod 24. The carriage 32 (and thusly the remains display 10, 100, 200) then pivots 30 to return the under surface of the carriage 32 to the rod 24, which imparts another pivot motion. The stops 31 limit the motion of the display 10, 100, 200 in either direction and serves to dampen the rocking effect.

Figure 6A:
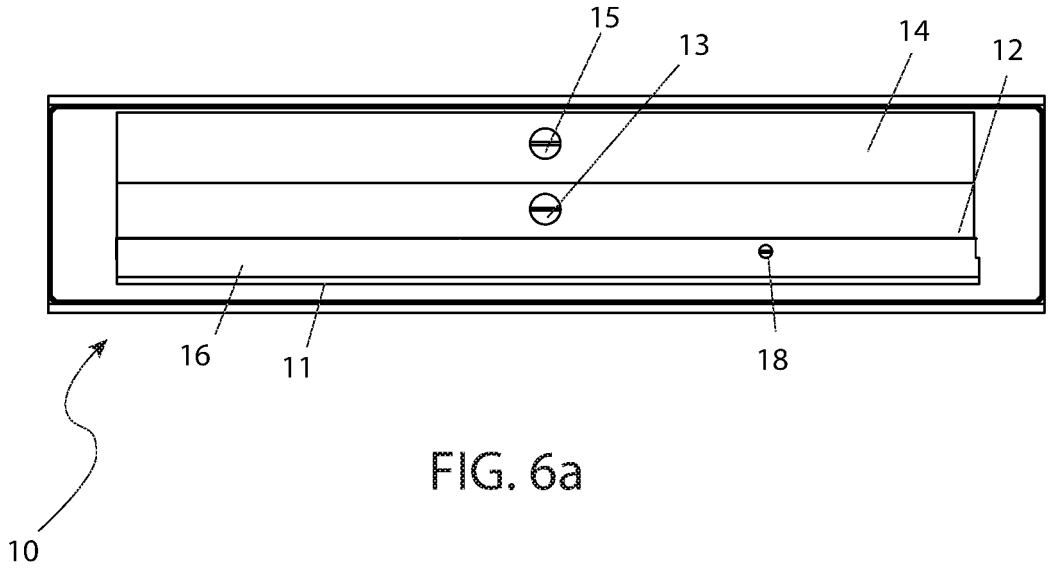
FIG. 6*a* is a top view of the remains display 10, according to a preferred embodiment of the present invention.

FIGS. 1 and 6*a* depict a remains display 10, where the decorative portion 11 constitutes is generally of the United States flag in a waving configuration. The overall shape of the remains display 10 is generally a rectangular prism, where the decorative portion 11 is configured with a waving red and white or transparent horizontal strips and white stars in a blue field.

Figure 6B:
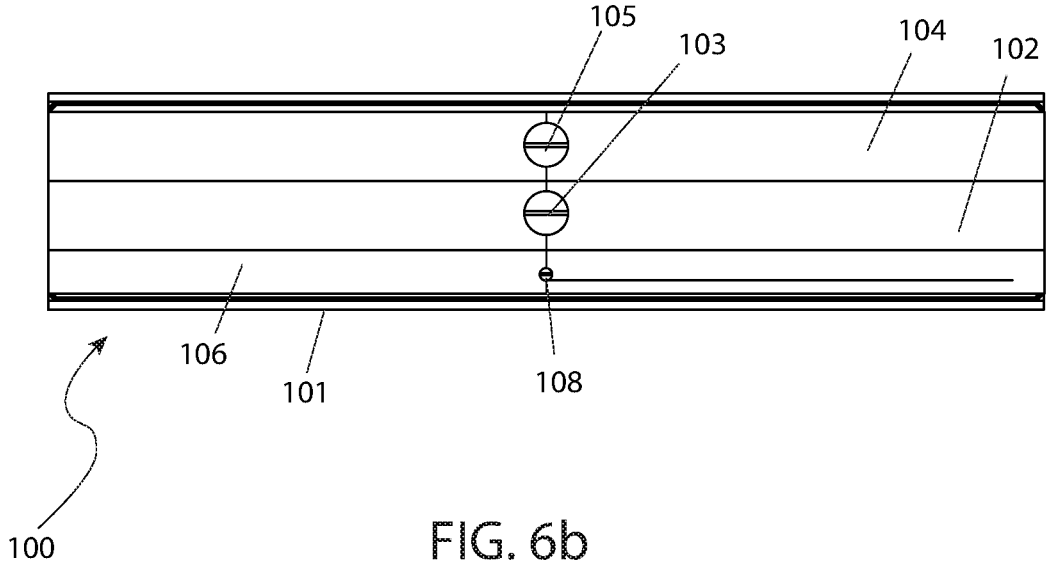
FIG. 6*b* is a top view of the first alternate display 100, according to a preferred embodiment of the present invention.

FIG. 6*b* depicts a first alternate display 100, which is generally of a typical beach scene. The first alternate display 100 is generally a semi-circular prism and has a first alternate decorative portion 101 that constitutes a semi-circular rainbow covering over a beach scene with sky, a palm tree, a boat, a lazy chair, and beach sand which spans between both distal ends of the rainbow. Although not illustrated herein, the first alternate display 100 has the same general construction as the remains display 10, having a transparent first alternate decorative portion 101, a first alternate reservoir 106 that may contain illumination, transparent or translucent colored material, or be filled with a fluid, and secured with a first alternate reservoir plug 108, and at least one (1) first alternate remains receptacle 102, 104, each with a respective receptacle plug 103, 105.

Figure 6C:
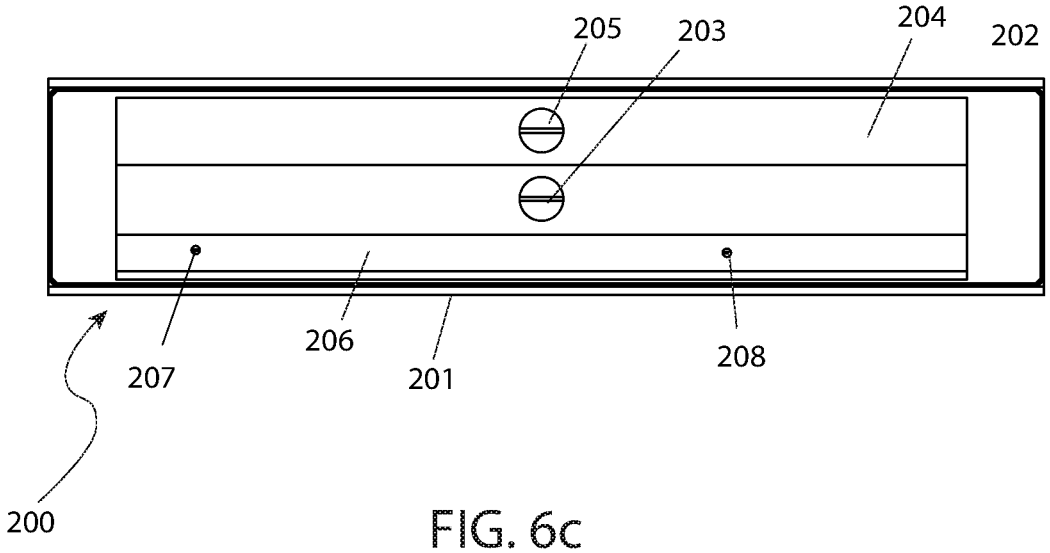
FIG. 6*c* is a top view of the second alternate display 200, according to a preferred embodiment of the present invention; and, FIG. 7 is an electrical block diagram of the remains display 10, 100, 200, according to a preferred embodiment of the present invention.

FIG. 6*c* depicts a second alternate display 200, where the second alternate decorative portion 201 is generally shaped as a heart with a pair of suspended miniature hearts each equidistant from an upper central point. The second alternate display 200 has the same general construction as the remains display 10 being a rectangular prism. The second alternate display 200 also has a transparent second alternate decorative portion 201, a second alternate reservoir 206 with a pair of fill ports each capable of being sealed with a respective reservoir plug 207, 208. The second alternate reservoir 206 may contain illumination, transparent or translucent colored material, or be filled with a fluid. Also, at least one (1) second alternate remains receptacle 202, 204, each with a respective receptacle plug 203, 205, is provided.

In this particular embodiment, the two (2) fill ports enable two (2) different areas that liquid can be introduced into the reservoir 206. The second alternate decorative portion 201 is thusly separated into a first decorative feature 211 and a second decorative feature 212. The first decorative feature 211 is in fluid communication with a first fill port (herein associated with the second alternate reservoir first plug 207) and the second decorative feature 212 is in fluid communication with a second fill port (herein associated with the second alternate reservoir second plug 208). The first decorative feature 211 is depicted as the field surrounding the second decorative features 212, which is depicted as the heart, miniature heart, and stem portions of the second alternate decorative portion 201.

Any portion of the displays 10, 100, 200 can be provided with different materials, such as tempered glass or regular glass. In preferred materials, the decorative portion 11, first alternate decorative portion 101, and second alternate decorative portion 201 comprises tempered glass, plastic, metallic, or organic materials and the reservoir 16, first alternate reservoir 106, second alternate reservoir 206, first remains receptacle 12, second remains receptacle 14, first alternate first remains receptacle 102, first alternate second remains receptacle 104, second alternate first remains receptacle 202, and second alternate second remains receptacle 204 comprise regular glass.

It is appreciated that the decorative portions 11, 101, 201 can be any particular type of display or written indicia and the present disclosure only serves to illustrate three (3) exemplary embodiments and should in no way attempt to provide a limiting factor to the overall scope.

Figure 7:
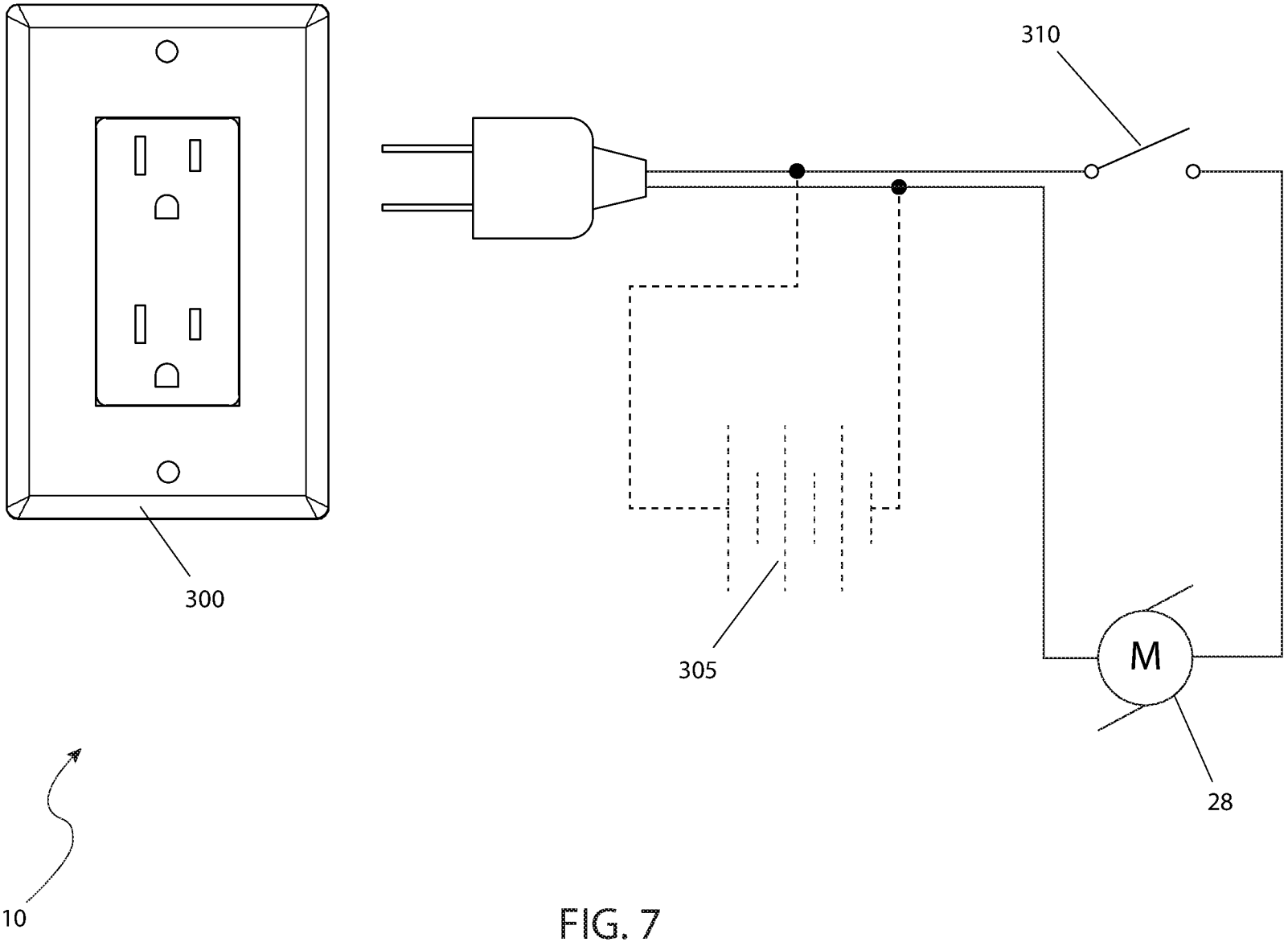

Referring to FIG. 7, an electrical block diagram of the cremation remains display 10, according to a preferred embodiment of the present invention is shown. Electrical power is provided by an AC power plug 300 or by a battery 305 depending on the specific model of the remains display 10, 100, 200 and/or where it is utilized. A controlling device 310, such as a switch as shown may be utilized to facilitate ON/OFF control of the remains display 10, 100, 200. Other methods of control such as a time, photelectric cell, proximity detector, and the like may also be utilized. The use of any particular type of controlling device 310 shall not be a limiting factor of the present invention. The resultant power then flows to the motor 28 of either an AC or DC variety depending on the use of an AC power plug 300 or battery 305 respectively.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A remains display, comprising:

a pair of remains receptacles having a first remains receptacle and a second remains receptacle, the pair of remains receptacles receive a plurality of cremated remains therein;

a decorative portion incorporated into a reservoir, a bottom surface of the reservoir, a bottom surface of the first remains receptacle and a bottom surface of the second remains receptacle are each fixedly attached to an upper surface of a planar carriage, a bottom surface of the planar carriage at the center point thereof is pivotally attached with a pivot to a base, said base defining a box;

a first alternate display having a first alternate first remains receptacle, a first alternate second remains receptacle, and a first alternate decorative portion capable of replacing the first remains receptacle, the second remains receptacle, and the decorative portion;

a second alternate display having a second alternate first remains receptacle; and a second alternate second remains receptacle, and a second alternate decorative portion capable of replacing the first remains receptacle, the second remains receptacle, and the decorative portion;

a motor electrically attached to a power supply secured within the base;

a motor gear in operable communication with an output shaft of the motor, the motor gear is meshed with and drives a first gear, the first gear is meshed with and drives a second gear, extending outward from the center of the second gear is a gear shaft that is rendered perpendicular from an upper wall and a lower wall of the box; and a rod driven by the gear shaft located off-center to produce a reciprocating action that extends vertically upward and penetrates through the box upper wall to contact an under surface of the planar carriage on either side of either one of a pair of stops affixed to the under surface, the stops limit motion of the remains display in either direction and serves to dampen any rocking.

2. The remains display according to claim 1, wherein the pair of remains receptacles are each a transparent sealed container having a receptacle fill port to facilitate transfer of the cremated remains within.

3. The remains display according to claim 2, wherein each of the receptacle fill ports are sealed with a respective receptacle plug.

4. The remains display according to claim 1, wherein the decorative portion, the first alternate decorative portion, and the second alternate decorative portion is made of material selected from the group consisting of tempered glass, plastic, metallic, or one or more organic materials.

5. The remains display according to claim 1, wherein the reservoir is a transparent sealed container having a reservoir fill port in fluid communication with an exterior environment to facilitate transfer of a liquid.

6. The remains display according to claim 5, wherein the reservoir fill port is sealed with a respective reservoir plug.

7. The remains display according to claim 5, wherein the reservoir incorporates illumination entrained within the liquid introduced therein.

8. The remains display according to claim 7, wherein the reservoir incorporate one or more floating objects entrained within the liquid introduced therein.

9. The remains display according to claim 1, wherein the planar carriage is an elongated rectangular prism.

10. The remains display according to claim 1, wherein the box upper wall is pivotally attached to the pivot and also has the rod in operable communication with the planar carriage.

11. The remains display according to claim 10, wherein on either side of the pivot is the pair of stops which are capable of restricting the rod on either side of the pivot.

12. The remains display according to claim 1, wherein the base includes the bottom wall, a pair of box first walls, a pair of box second side walls, and the upper wall, the bottom wall, the upper wall, the pair of first side walls, and the pair of second side walls are planar and joined at edges thereof to form the box with a hollow interior.

13. The remains display according to claim 12, wherein the pair of box first side walls are coextensive with each other and the pair of box second side walls are coextensive with each other.

14. The remains display according to claim 12, wherein the pair of box first walls are longer in length than the pair of box second side walls and the pair of box first side walls have a larger height that the pair of box second side walls.

15. The remains display according to claim 1, wherein the rod gently contacts an under surface of the planar carriage, which then imparts a pivoting motion to the planar carriage due to the pivot between the planar carriage and the base in a direction opposite the location of the rod.

16. The remains display according to claim 1, wherein the planar carriage then pivots to return the under surface of the planar carriage to the rod, which imparts another pivot motion.

17. The remains display according to claim 1, wherein the power supply is a battery.

18. The remains display according to claim 1, wherein the power supply is a cord in electrical communication with a wall outlet.

19. The remains display according to claim 1, wherein the motor gear, the first gear, and the second gear is rotatably supported within the base or to each other.

20. The remains display according to claim 19, wherein the second gear is a larger gear than the motor gear to provide a step-down in rotation velocity so as to impart a slow but steady vertical reciprocating movement to the rod.

* * * * *